US012085373B2

(12) United States Patent
Myers

(10) Patent No.: US 12,085,373 B2
(45) Date of Patent: Sep. 10, 2024

(54) MAGNETIC SHOTGUN SHELL HOLDER

(71) Applicant: Kenneth Chance Myers, Lenox, GA (US)

(72) Inventor: Kenneth Chance Myers, Lenox, GA (US)

( * ) Notice: Subject to any disclaimer, the term of this patent is extended or adjusted under 35 U.S.C. 154(b) by 0 days.

(21) Appl. No.: 17/730,513

(22) Filed: Apr. 27, 2022

(65) Prior Publication Data

US 2023/0349680 A1 Nov. 2, 2023

(51) Int. Cl.
*F42B 39/02* (2006.01)

(52) U.S. Cl.
CPC ..... *F42B 39/02* (2013.01)

(58) Field of Classification Search
CPC . F42B 39/02; A45C 13/02; B25H 3/00; Y10S 206/818; Y10S 211/01; Y10S 224/931
See application file for complete search history.

(56) References Cited

U.S. PATENT DOCUMENTS 4,826,059 A * 5/1989 Bosch ..... A45C 11/24 211/DIG. 1
5,121,564 A * 6/1992 Story ..... F41C 27/00 224/931
5,660,276 A * 8/1997 Winnard ..... B25H 3/028 211/DIG. 1
8,590,681 B2 * 11/2013 Shrewsbury ..... A45C 13/103 383/14
8,613,157 B2 * 12/2013 McCaffery ..... F42B 39/02 224/931
2005/0121485 A1 * 6/2005 Spicer ..... F42B 39/02 224/931
2009/0277937 A1 * 11/2009 Sabbag ..... B25H 3/00 224/601
2016/0313105 A1 * 10/2016 Olroyd ..... F42B 39/02

* cited by examiner

*Primary Examiner* — Corey N Skurdal

(74) *Attorney, Agent, or Firm* — Rapacke Law Group; Andrew Rapacke

(57) ABSTRACT

A magnetic shotgun shell holder is disclosed, including a first half and a second half each configured to retain a plurality of shells therein. A magnetic member is disposed within each of the first half and the second half. The magnetic member retains each of the plurality of shells within the first half and the second half. The magnetic shotgun shell holder is configured to be worn by a user or retained on a shotgun or other object and protects the shells from damage during hunting, transportation, and other shooting activities.

16 Claims, 5 Drawing Sheets

MAGNETIC SHOTGUN SHELL HOLDER

TECHNICAL FIELD

The present invention is generally related to shotgun shell holders used during shotgun shooting activities such as waterfowl hunting.

BACKGROUND

A shotgun shell is a type of rimmed, cylindrical cartridge used specifically by shotguns. The shell is typically loaded with one or numerous small spherical sub-projectiles called shot. Shotguns, and their rounds are advantageous in bird hunting as well as the hunting of other small, often fast moving, game due to the widened spread pattern of the shot.

During hunting activities, hunters carry enough shells on their person to sustain the entire duration of the hunt. Many hunters simply deposit shells into their pockets, daypack, or waist bag which they repeatedly access throughout hunting to reload their shotgun. Recently, shell carriers have been developed which include material configured to retain the shell therein via a friction fit.

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments provided herein relate to a magnetic shotgun shell holder, including a first half and a second half each configured to retain a plurality of shells therein. A magnetic member is disposed within each of the first half and the second half. The magnetic member retains each of the plurality of shells within the first half and the second half. The magnetic shotgun shell holder is configured to be worn by a user or retained on a shotgun or other object and protects the shells from damage during hunting, transportation, and other shooting activities.

The magnetic shotgun shell holder is designed having an in-use and open configuration as well as a closed configuration, thus allowing user-selected configuration while hunting, during transportation, and during storage. The in-use and open configuration provides easy access to shells while ensuring the shells do not fall out and become damaged, soiled, or otherwise become unusable.

In one aspect, the magnetic member comprises a top surface having a plurality of magnetic elements positioned thereon.

In one aspect, the plurality of magnetic elements are positioned on a central portion of the top surface.

In one aspect, each of the plurality of magnetic elements retains one of the plurality of shells.

In one aspect, the first half is comprised of a first inner side and a first outer side. The first inner side and the first outer side define a first interior cavity which retains a row of the plurality of shells.

In one aspect, the second half is comprised of a second inner side and a second outer side to define a second interior cavity.

In one aspect, the main body includes a loop on each of the first half and the second half, wherein each loop is releasably engaged with the at least one retainer.

BRIEF DESCRIPTION OF THE DRAWINGS

A more complete understanding of the embodiments, and the attendant advantages and features thereof, will be more readily understood by reference to the following detailed descriptions when considered in conjunction with the accompanying drawings wherein.

DETAILED DESCRIPTION

Figure 1:
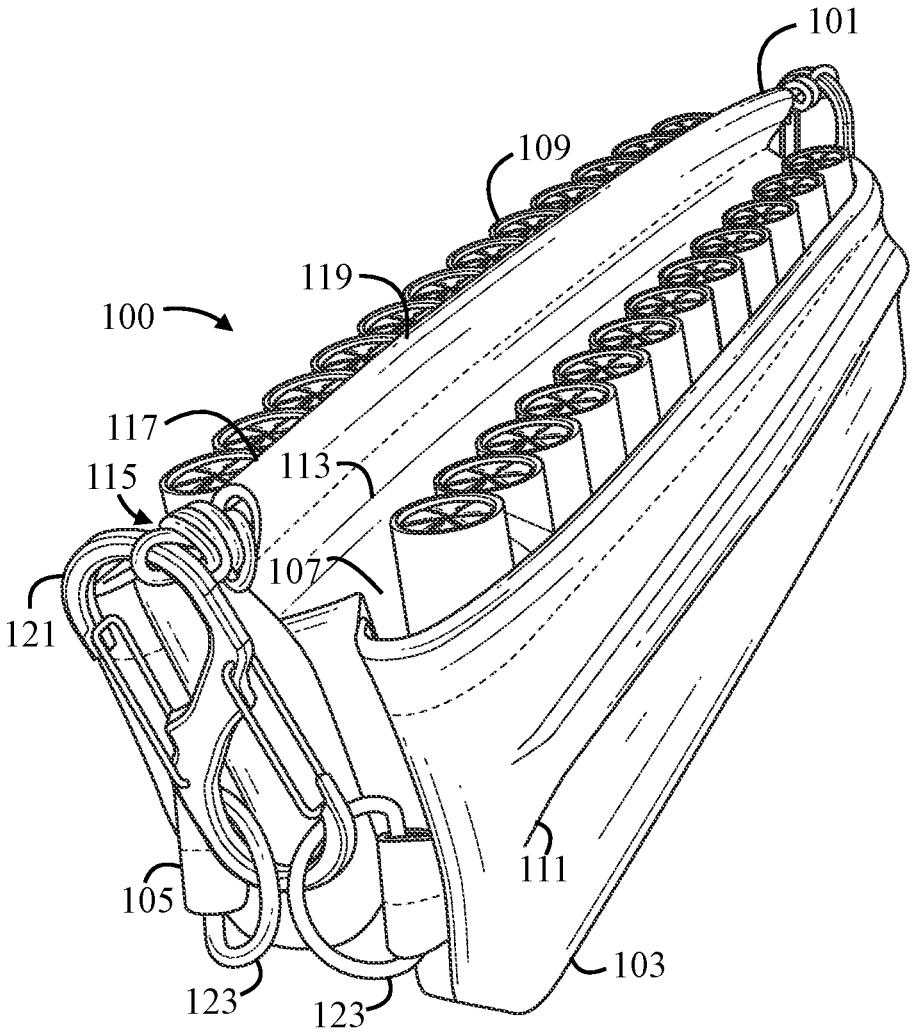
FIG. 1 illustrates a perspective view of the magnetic shotgun shell holder in an in-use configuration, according to some embodiments.

The specific details of the single embodiment or variety of embodiments described herein are outlined in this application. Any specific details of the embodiments are used for demonstration purposes only, and no unnecessary limitations or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure, so as not to obscure the disclosure with details other than those readily apparent to those of ordinary skill in the art having the benefit of the description herein.

In general, the embodiments provided herein relate to a magnetic shotgun shell holder which retains shotgun shells (hereinafter referred to simply as "shell" or "shells") for waterfowl hunting. The magnetic shotgun shell holder is configured to protect the shells during transportation and allow for easy access during hunting or other shooting activities. The magnetic shotgun shell holder is configurated to work with waterfowl hunting waders but can be adapted for use with other devices that allow attachment such as a harness, boat, firearm, or a tree. The magnetic shotgun shell holder retains the shells within an interior cavity via a plurality of magnets to prevent shells from falling out during transportation.

While the example of shotgun shells and a shotgun are utilized herein, one skilled in the arts may readily apply the embodiments to other ammunition types and firearm types.

FIG. 1 illustrates a perspective view of the magnetic shotgun shell holder 100 in an open configuration 101. The magnetic shotgun shell holder 100 includes main body 102 including a first half 103 and a second half 105 each having an interior cavity 107 for retaining a plurality of shells 109 therein. The first half 103 includes a first outer side 111 and a first inner side 113 which retain the shells 109 therein. The second half 105 includes a second outer side 115 and a second inner side 117 which retain the shells 109 therein such that there are two rows of shells. The first inner side 113 and the second inner side 117 form a central wall 119 which separates the first half 103 and the second half 105. One or more retainers 121 (e.g., a clip, carabiner, or similar apparatus is provided to retain the magnetic shotgun shell holder 100 in an in-use configuration via a loop 123 positioned on each of the first half 103 and the second half 105.

In some embodiments, the one or more retainers 121 is a single carabiner connected to each loop 123. In use, the user engages the carabiner between each loop 123 on the first half 103 and the second half 105 to retain the magnetic shotgun shell holder in the in use or closed configurations as needed.

Figure 2:
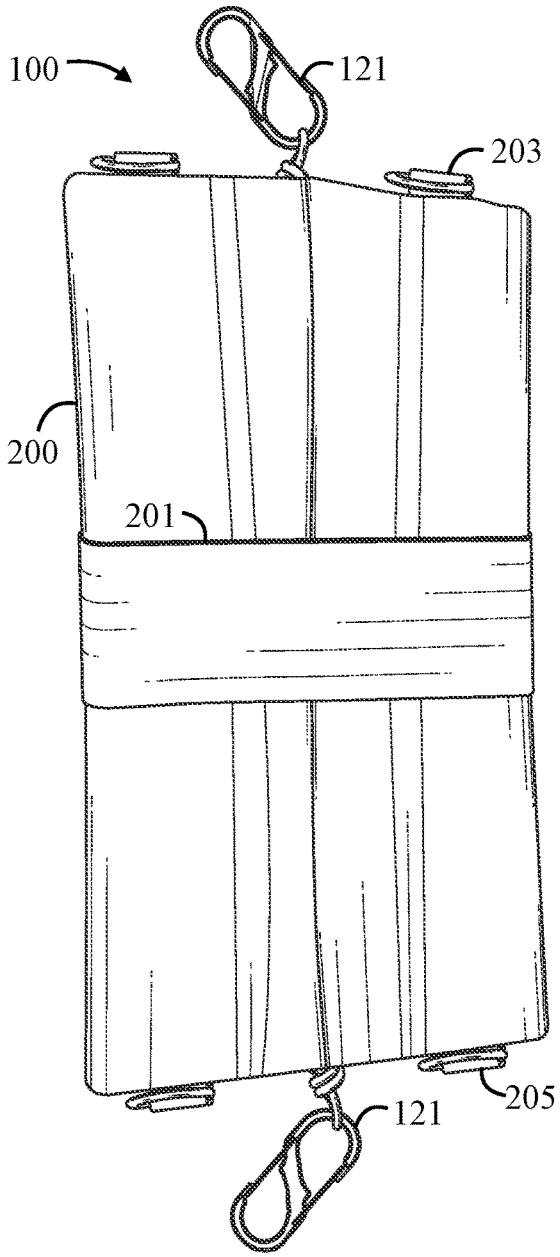
FIG. 2 illustrates a perspective view of the magnetic shotgun shell holder in a closed configuration, according to some embodiments.
Figure 3:
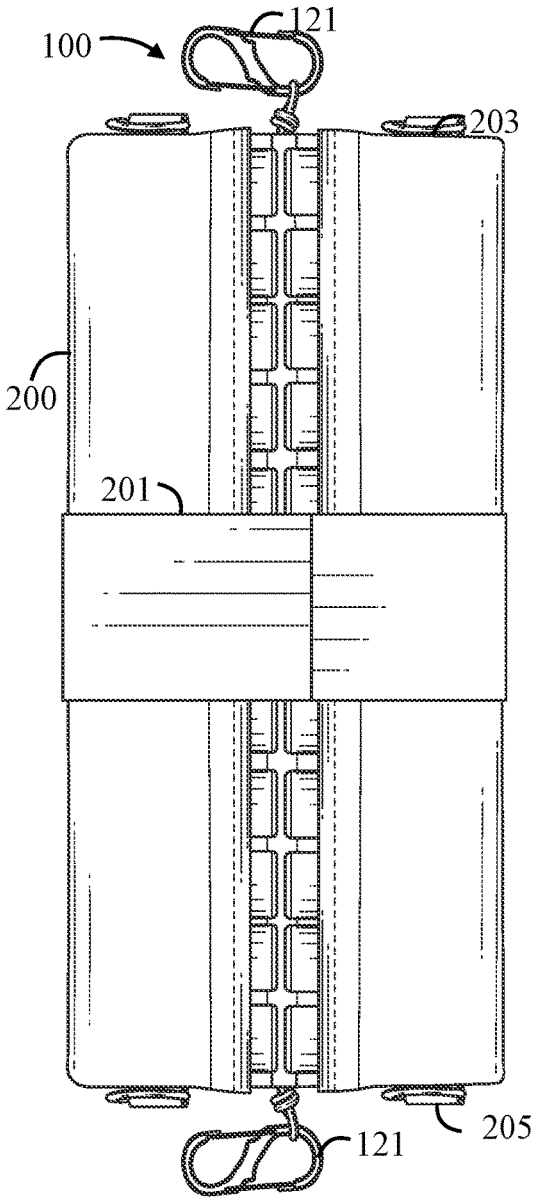
FIG. 3 illustrates a perspective view of the magnetic shotgun shell holder in a closed configuration, according to some embodiments.

FIG. 2 and FIG. 3 illustrate perspective views of the magnetic shotgun shell holder 100 in a closed configuration 200. The closed configuration 200 may be useful for transporting the shells within the magnetic shotgun shell holder 100, especially in hazardous environments. A strap 201 is provided and capable of wrapping around the shotgun shell holder 100 to retain it in a closed configuration 200. Retainers 121 are positioned on the first side 203 and the second side 205 to allow the user to releasably engage the magnetic shotgun shell holder 100 with a garment, firearm, or other object (see FIG. 4, FIG. 7 and FIG.).

Figure 4:
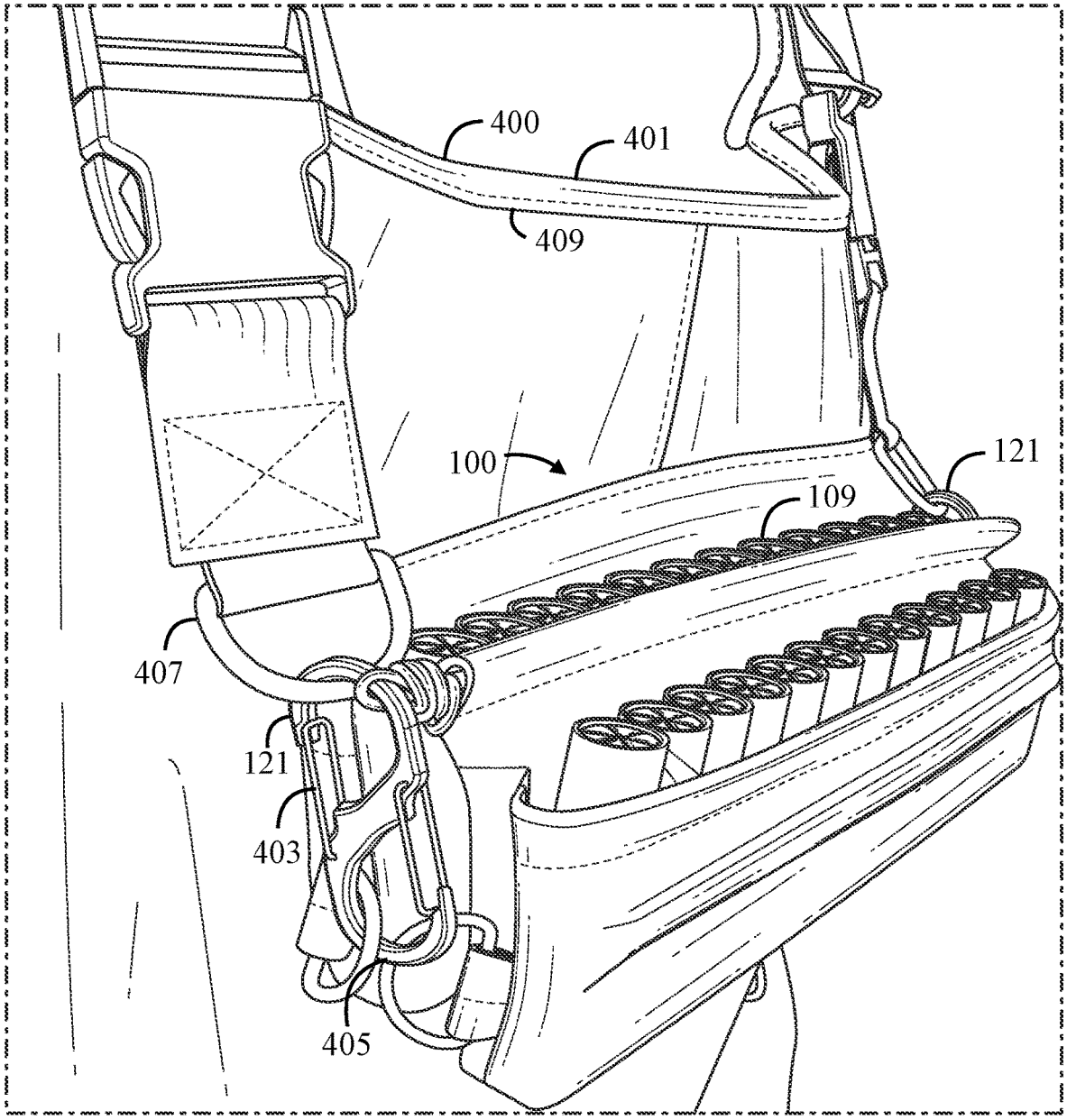
FIG. 4 illustrates a perspective view of the magnetic shotgun shell holder in an in-use configuration worn by a user, according to some embodiments.

FIG. 4 illustrates a perspective view of the magnetic shotgun shell holder 100 in an in-use configuration 101 worn by a user 400. In some embodiments, the user 400 wears the magnetic shotgun shell holder 100 on the front of the torso 401. The retainers 121 may include a top loop 403 and a bottom loop 405. The top loop 403 engages with a receiver 407 positioned on the garment 409 worn by the user 400. The bottom loop 405 engages the loops 123 to retain the magnetic shotgun shell holder 100 in an in-use configuration. During use, the shells 109 are positioned to be accessible from the top such that the user 400 may readily retrieve the shells 109 as needed during hunting or other shooting practices. As discussed hereinabove, the retainers 121 may be carabiners.

Figure 5:
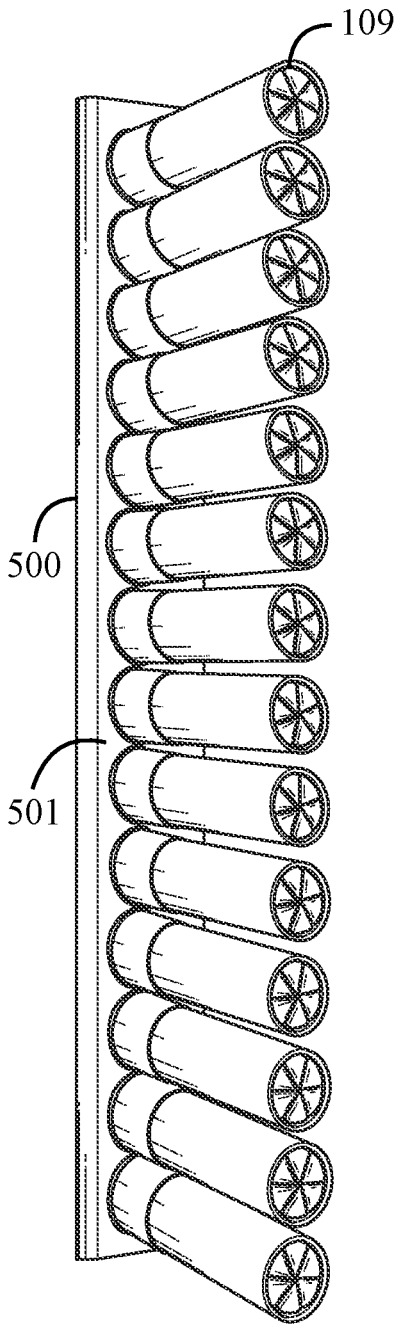
FIG. 5 illustrates a perspective view of the magnetic member holding a plurality of shells, according to some embodiments.
Figure 8:
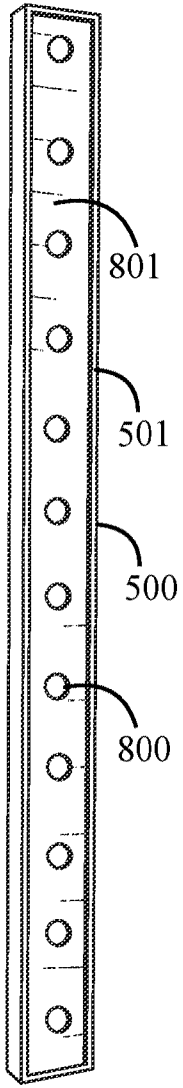
FIG. 8, illustrates a perspective view of a magnetic members, according to some embodiments.

FIG. 5 illustrates a perspective view of the magnetic member 500 holding a plurality of shells 109. The magnetic member 500 is configured to retain the shells 109 via magnetic elements 800 (see FIG. 8). Shells are positioned such that the metal covering contacts the top surface 501 of the magnetic member 500. FIG. 8 illustrates the magnetic member 500 without shells retained therein. A plurality of magnetic elements 800 are positioned along the central portion 801 of the top surface 501 to magnetically engage the shells.

Figure 6:
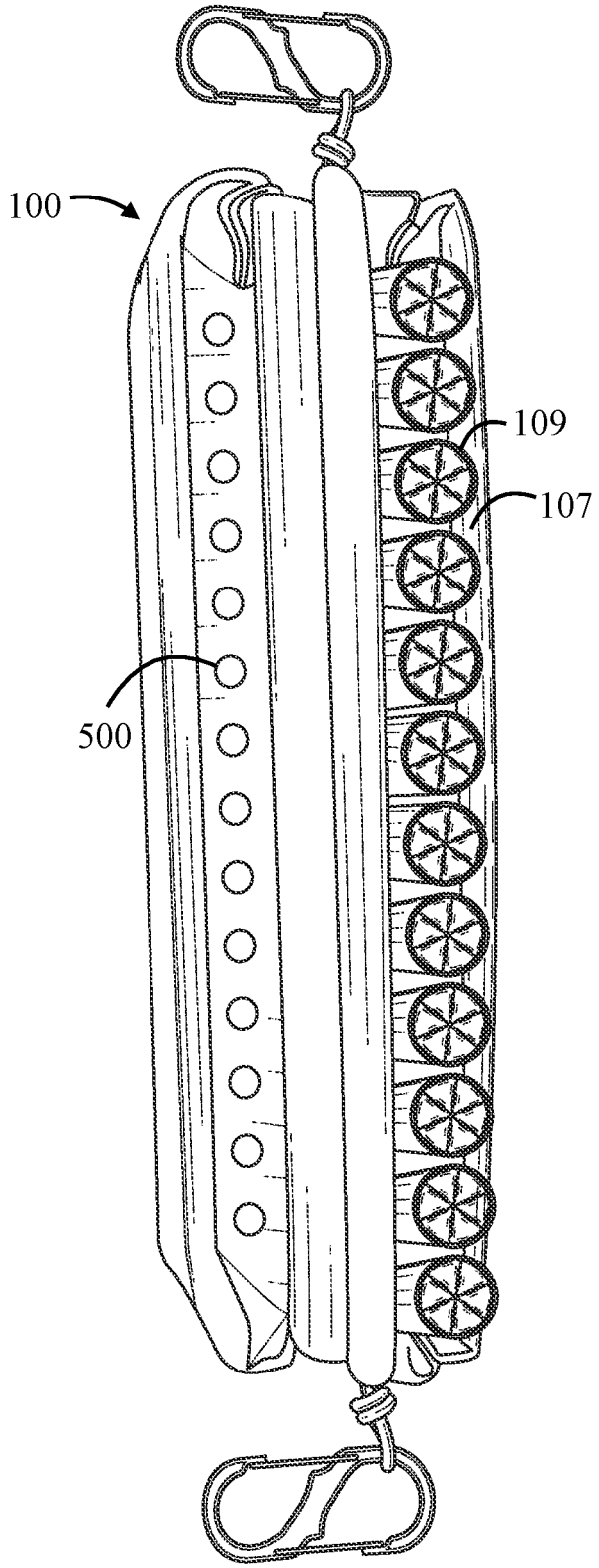
FIG. 6 illustrates a perspective view of the magnetic shotgun shell holder in an in-use configuration holding a plurality of shells, according to some embodiments.

FIG. 6 illustrates a perspective view of the magnetic shotgun shell holder 100 in an in-use configuration holding a plurality of shells 109. The magnetic member 500 is illustrated positioned within the interior cavity 107 such that the user can easily and efficiently load and retrieve shells 109 into the interior cavity 107.

Figure 7:
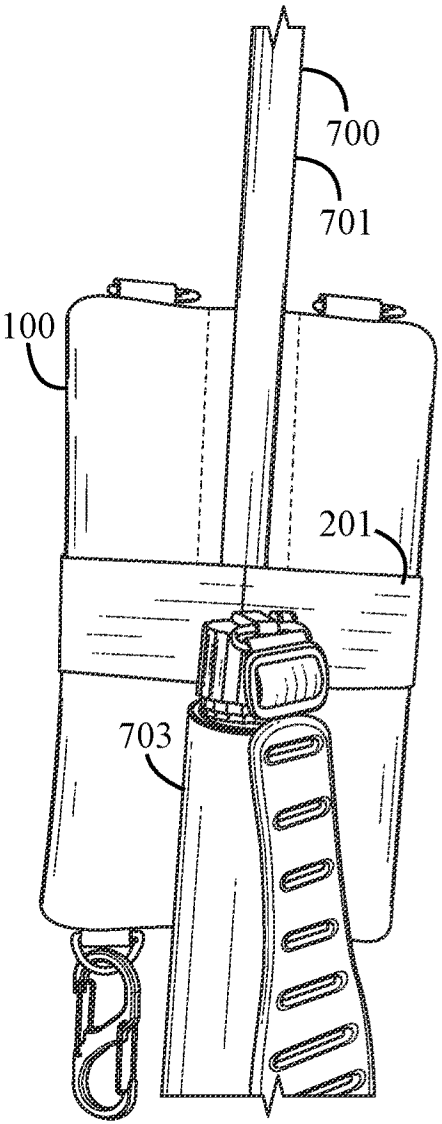
FIG. 7 illustrates a perspective view of the magnetic shotgun shell holder releasably retained to a shotgun, according to some embodiments.

FIG. 7 illustrates a perspective view of the magnetic shotgun shell holder 100 releasably retained to a shotgun 700. The strap 201 may be utilized to wrap around the magnetic shotgun shell holder 100 and shotgun 700 to retain the magnetic shotgun shell holder 100 thereon. This may be useful when shoulder-carrying the shotgun while standing and/or walking. The strap 201 may engage with the barrel 701 such that when the shotgun 100 is carried on the shoulder the magnetic shotgun shell holder 100 is retained on the barrel 701 via a friction fit with the strap 201 and/or by being retained above the forend 703.

Figure 9:
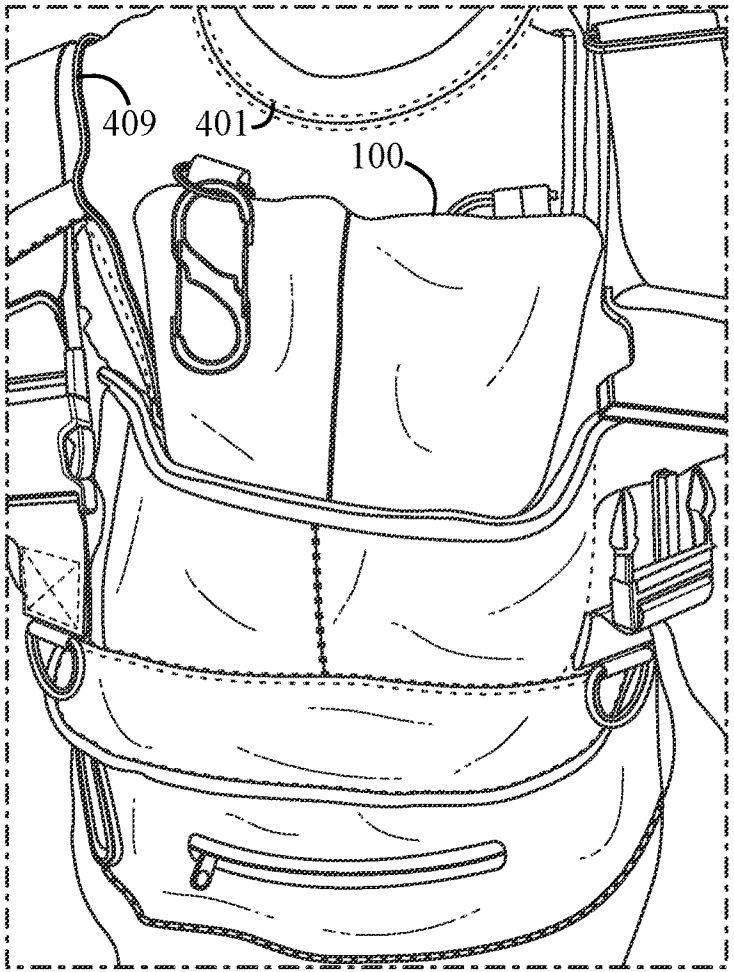
FIG. 9 illustrates a perspective view of the magnetic shotgun shell holder in a closed configuration and retained within a wader worn by the user, according to some embodiments.

FIG. 9 illustrates a perspective view of the magnetic shotgun shell holder 100 in closed configuration 200 (which may also be viewed in FIG. 2 and FIG. 3) and retained within a garment 409 (e.g., a wader). The magnetic shotgun shell holder 100 may be dimensioned to be retained between the garment 409 and the torso 401 such that the magnetic shotgun shell holder 100 is readily accessible when needed.

It is noted that the magnetic shotgun shell holder 100 may be carried with or without shells being stored therein. It may be readily retained on various objects as well as on the user's person such that the shells are protected from damage including that incurred by impact, debris, moisture, and the like.

Many different embodiments have been disclosed herein, in connection with the above description and the drawings. It will be understood that it would be unduly repetitious and obfuscating literally to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support all claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A magnetic shotgun shell holder, comprising:

a first half and a second half comprising a cavity, wherein each cavity is configured to retain a plurality of shells therein;

a magnetic member disposed within each of the cavities, the magnetic member to retain each of the plurality of shells within each cavity, wherein:

the magnetic member comprises a top surface having a plurality of magnetic elements positioned on a central portion of the top surface of the magnetic member integrated into walls of each cavity and located across a horizontal plane of the walls of each cavity;

each of the plurality of magnetic elements is configured to retain one of the plurality of shells within the walls of each cavity; and the magnetic shotgun shell holder is releasably engageable to a barrel via a strap.

2. The magnetic shotgun shell holder of claim 1, wherein the first half is comprised of a first inner side and a first outer side.

3. The magnetic shotgun shell holder of claim 2, wherein the first inner side and the first outer side define a first interior cavity.

4. The magnetic shotgun shell holder of claim 3, wherein the first interior cavity retains a row of the plurality of shells.

5. The magnetic shotgun shell holder of claim 1, wherein the second half is comprised of a second inner side and a second outer side.

6. A magnetic shotgun shell holder, comprising:

a main body including a first half and a second half comprising a cavity defined by walls, wherein each cavity is configured to retain a plurality of shells within the walls;

a magnetic member disposed within each of the cavities, the magnetic member is configured to retain each of the plurality of shells within the each cavity, wherein the magnetic member comprises a top surface having a plurality of magnetic elements positioned on a central portion of the top surface of the magnetic member integrated into walls of each cavity and located across a horizontal plane of the walls of each cavity; and at least one retainer to retain the magnetic shotgun shell holder in an in-use configuration or a closed configuration, wherein the at least one retainer is selectively engaged with a garment to retain the main body on the garment of a user.

7. The magnetic shotgun shell holder of claim 6, wherein the magnetic member comprises a top surface having a plurality of magnetic elements positioned thereon.

8. The magnetic shotgun shell holder of claim 7, wherein the plurality of magnetic elements are positioned on a central portion of the top surface.

9. The magnetic shotgun shell holder of claim 8, wherein each of the plurality of magnetic elements retains one of the plurality of shells.

10. The magnetic shotgun shell holder of claim 9, wherein the first half is comprised of a first inner side and a first outer side.

11. The magnetic shotgun shell holder of claim 10, wherein the first inner side and the first outer side define a first interior cavity.

12. The magnetic shotgun shell holder of claim 11, wherein the first interior cavity retains a row of the plurality of shells.

13. The magnetic shotgun shell holder of claim 12, wherein the second half is comprised of a second inner side and a second outer side.

14. The magnetic shotgun shell holder of claim 6, wherein the main body includes a loop on each of the first half and the second half, wherein each loop is releasably engaged with the at least one retainer.

15. The magnetic shotgun shell holder of claim 6, further comprising a strap to retain the main body in the closed configuration.

16. The magnetic shotgun shell holder of claim 15, wherein the strap releasably retains the main body on a barrel of a shotgun.

* * * * *